US006295686B1

(12) United States Patent
Phillips

(10) Patent No.: US 6,295,686 B1
(45) Date of Patent: Oct. 2, 2001

(54) FLEXIBLE TOOTHBRUSH

(75) Inventor: Joseph E. Phillips, Osseo, WI (US)

(73) Assignee: PHB, Osseo, WI (US)

( * ) Notice: Subject to any disclaimer, the term of this patent is extended or adjusted under 35 U.S.C. 154(b) by 0 days.

(21) Appl. No.: 09/313,821

(22) Filed: May 18, 1999

(51) Int. Cl.[7] ..... A46B 9/04; A46B 5/02
(52) U.S. Cl. ..... 15/167.1; 15/143.1
(58) Field of Search ..... 15/143.1, 167.1, 15/172

(56) References Cited

U.S. PATENT DOCUMENTS 4,520,526 * 6/1985 Peters .
4,691,404 * 9/1987 Tarrson .
5,146,645 * 9/1992 Dirksing .
5,272,784 12/1993 Levin .
5,488,751 * 2/1996 Gekhter .
5,735,012 * 4/1998 Heinzelman .
5,758,383 * 6/1998 Hohlbein .
5,815,874 * 10/1998 Weihrauch .
5,903,949 * 5/1999 Halm .
5,946,759 * 9/1999 Cann .

OTHER PUBLICATIONS

Shell Chemicals, Material Safety Data Sheet, MSDS No. 2.863, Product: Kraton DRP6031 Thermoplastic Rubber, Chemical Name: Styrene–Butadiene–Styrene Block Copolymer.

Shell Chemicals, Kraton Polymers, page from Shell Chemical's website http:/www2.shellchemical.com, printed on Jul. 21, 1999.

Shell Chemicals, Kraton D Polymers, page from Shell Chemical's website http:/www2.shellchemical.com, printed on Jul. 21, 1999.

Shell Chemicals, Kraton G Polymers, page from Shell Chemical's website http:/www2.shellchemical.com, printed on Jul. 21, 1999.

* cited by examiner

*Primary Examiner*—Randall E. Chin
(74) *Attorney, Agent, or Firm*—Skinner and Associates

(57) ABSTRACT

A toothbrush, comprising a body having a head portion, a neck portion connected to the head portion, and a handle portion connected to the neck portion, and further comprising a plurality of bristles attached to the head portion. The body comprises a thermoplastic elastomer that is sufficiently strong to be used in the normal, intended manner for dental hygiene purposes and is sufficiently flexible to resist being fashioned into and used as a weapon. In a preferred embodiment, the body comprises approximately 50% Kraton™ DRP6031 thermoplastic rubber and approximately 50% polypropylene.

2 Claims, 2 Drawing Sheets

FLEXIBLE TOOTHBRUSH

BACKGROUND OF THE INVENTION

1. Field of the Invention

The present invention relates, generally, to toothbrushes for performing dental hygiene functions. More particularly, the invention relates to flexible toothbrushes that resist being fashioned into and used as a weapon.

2. Background Information

The state of the art in general includes various toothbrushes that typically have a plastic handle of about five inches in length and a width of 0.3 inches that are typically formed of polyethylene or polypropylene. These handles can be abraded into relatively sharp and dangerous weapons, and pose a significant safety problem for those who may endanger themselves or others, including the developmentally and physically impaired and the incarcerated.

U.S. Pat. No. 5,272,784 shows a toothbrush handle structure that is constructed of polypropylene with significant open cutouts in the length of the handle. The handle is made with two or more parallel frame members which are cross connected at spaced locations. The handle has multiple open space cutouts that are claimed to reduce the ability of the handle to be abraded and sharpened into a point.

Applicant's invention provides a flexible toothbrush handle which is believed to constitute an improvement over existing technology.

BRIEF SUMMARY OF THE INVENTION

The present invention provides a flexible toothbrush which generally comprises a body. Structurally, the body has a head portion that contains bristles, a neck portion, and a handle portion. The neck portion has a smaller width than the head portion and the handle portion, allowing the neck portion to flex more readily upon the application of a force. Further, the dimensions of the handle are such that it will readily flex upon the application of the force.

The body is formed from a flexible material such as a thermoplastic rubber. Shell Chemical's Kraton™ polymers are thermoplastic elastomers that are characterized as elastic, flexible, and easy to process in economical thermoplastic processing methods. Used in high enough concentrations as an additive, Kraton polymers improve the flexibility, softness, elasticity and feel of certain plastics. The brush of the present invention preferably comprises approximately 50% polypropylene and approximately 50% Kraton polymers.

The features, benefits and objects of this invention will become clear to those skilled in the art by reference to the following description, claims and drawings.

DETAILED DESCRIPTION

Figure 1:
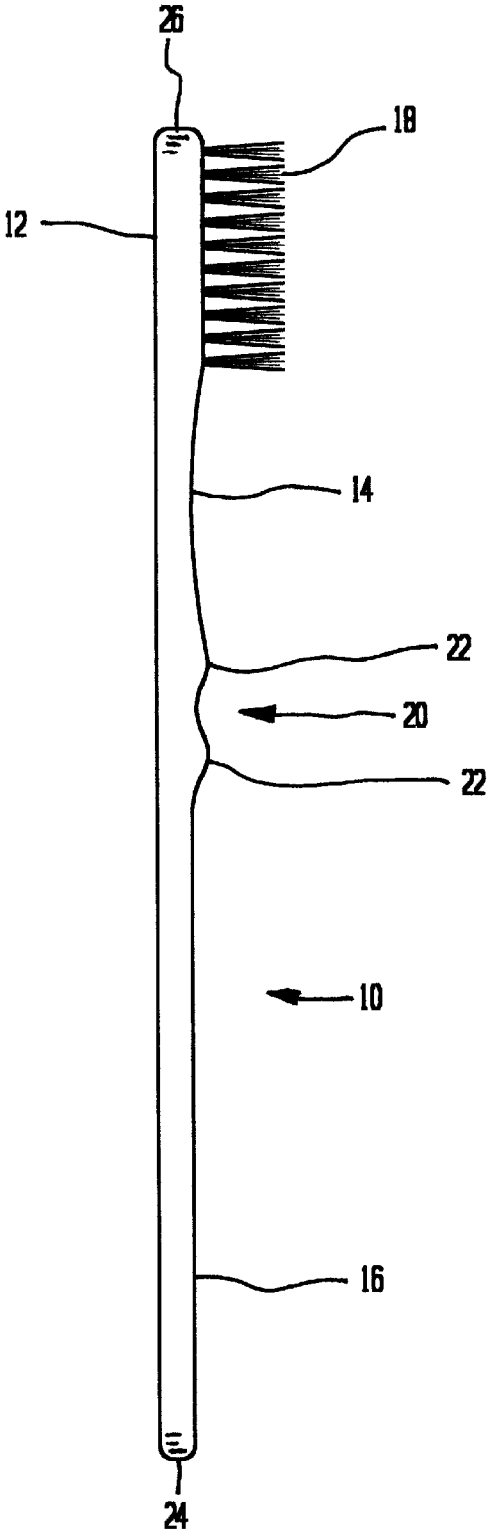
FIG. 1 is side view of the flexible toothbrush of the present invention.

Referring to FIGS. 1–4, an example of the preferred embodiment of the present invention is illustrated and generally indicated by the reference numeral 10. The toothbrush 10 is described below first in terms of its structural elements and then in terms of its composition which cooperate to provide a flexible toothbrush that is sufficiently strong or rigid to be used in the normal, intended manner for dental hygiene purposes and that is sufficiently flexible to resist being fashioned into and used as a weapon. The invention is particularly well-suited for use in jails, prisons, hospitals, and other secure environments.

Figure 2:
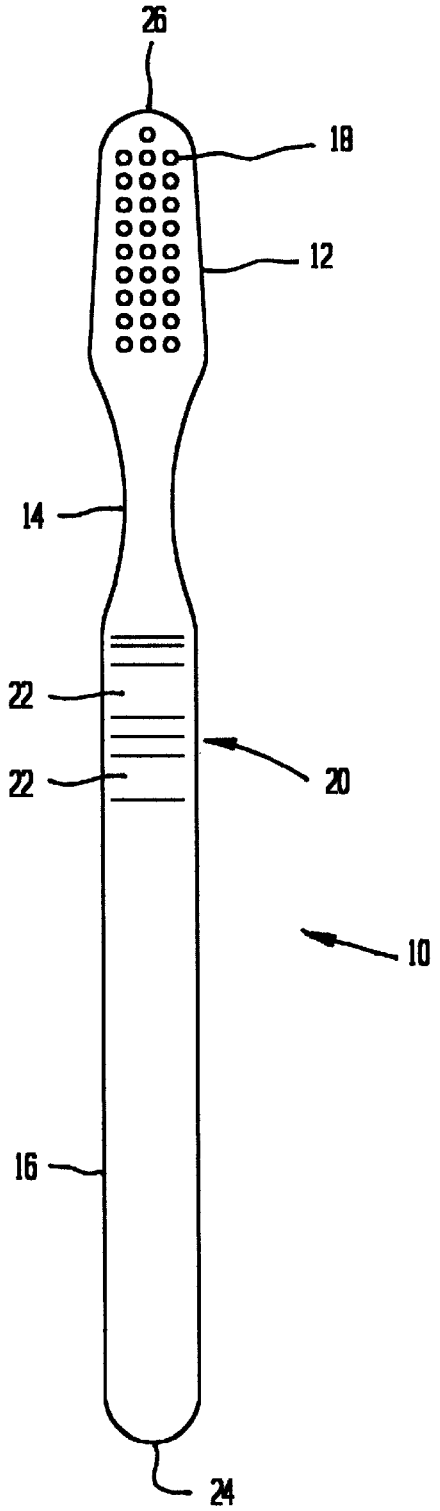
FIG. 2 is a front view of the flexible toothbrush of FIG. 1.

Referring to FIGS. 1–2, the toothbrush 10 has a unitary body that, in a preferred embodiment, is generally 7 inches long, ½ inch wide, and ¼ inch high. The body has a head portion 12, a neck portion 14 and a handle portion 16. The head portion has twenty-eight tufts of 0.007" diameter end-rounded bristles 18. The bristles 18 extend about ½ inch from the surface of the head portion 12. The head portion is approximately 1½ inches long, ranges from approximately ⅜ to ½ inch wide, and is ¼ inch high. The neck portion 14 is integrally formed adjacent to the head portion 12, and is approximately 1 inch long, ranges from approximately 5/16 to ½ inch wide, and is approximately ¼ inch high. The handle portion 16 is integrally formed adjacent to the neck portion 14, and is approximately 4½ inches long, ranges from approximately 7/16 to 9/16 inches wide, and is approximately ¼ inch high. A grip portion 20 is formed in the handle portion 16. The grip portion 20 includes two protuberances 22 that bulge approximately 1/16 inch away from the surface of the handle portion 16. The overall length of the two protuberances 22 that form the grip portion is approximately 1 inch. The head portion 12, neck portion 14 and handle portion 16 are formed without sharp edges or pointed ends. In particular, the body of the toothbrush 10 has a blunt or rounded proximal end 24 and distal end 26.

The flexible body of the toothbrush 10 is formed from a thermoplastic rubber. Shell Chemical's Kraton™ polymers are thermoplastic elastomers that are characterized as elastic, flexible, and easy to process in economical thermoplastic processing methods. Used in high enough concentrations as an additive, Kraton polymers improve the flexibility, softness, elasticity and feel of certain plastics.

In a preferred embodiment, the body is formed from Kraton DRP6031 thermoplastic rubber. Kraton DRP6031 thermoplastic rubber is a Styrene-Butadiene-Styrene Block Copolymer. Further, the preferred embodiment includes a mint flavoring. Additionally, the preferred embodiment comprises approximately 50% polypropylene and approximately 50% Kraton DRP6031 thermoplastic rubber. The preferred Kraton DRP6031 thermoplastic rubber is formed from a mixture of the compositions in the amounts shown in Table 1.

TABLE 1

| Composition | Percentage |
|---|---|
| Styrene-Butadiene-Styrene Block Copolymer | <65% |
| Mineral Oil | <40% |
| EVA Copolymer | <10% |
| Polystyrene | <10% |
| Titanium Dioxide | <5% |
| Calcium Stearate | <1% |
| Antioxidant/Stabilizer | <1% |

Each molecule of the Kraton polymer composition comprises block segments of styrene monomer units and rubber monomer units. The Kraton polymer molecule has an A-B-A structure, including polystyrene endblocks and an elastomeric or rubber midblock. The physical crosslinking and reinforcing effect of the styrene domains gives Kraton polymers their high tensile strength and the rubber midblock gives Kraton polymers their elasticity. Thus, the Kraton polymers provide a toothbrush handle 16 that is sufficiently strong to be used in the normal, intended manner for dental hygiene, and is sufficiently flexible to resist being fashioned into and used as a weapon. Kraton polymers are injection moldable or extrudable, which provides an economical means to manufacture the flexible toothbrush of the present invention using thermoplastic processing methods.

Figure 3:
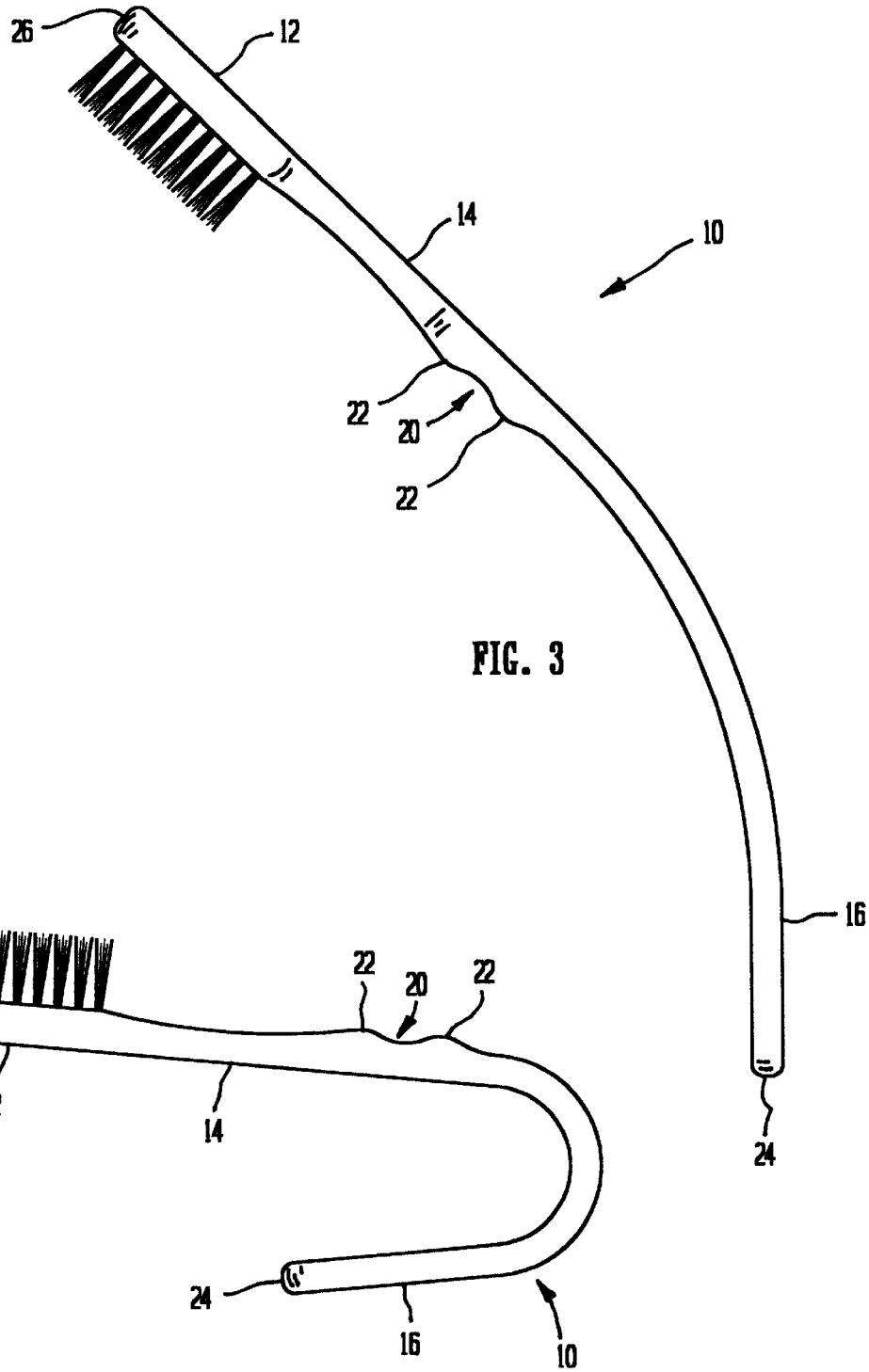
FIG. 3 is a side view of a side view of the flexible toothbrush of FIG. 1 in a flexed position.
Figure 4:
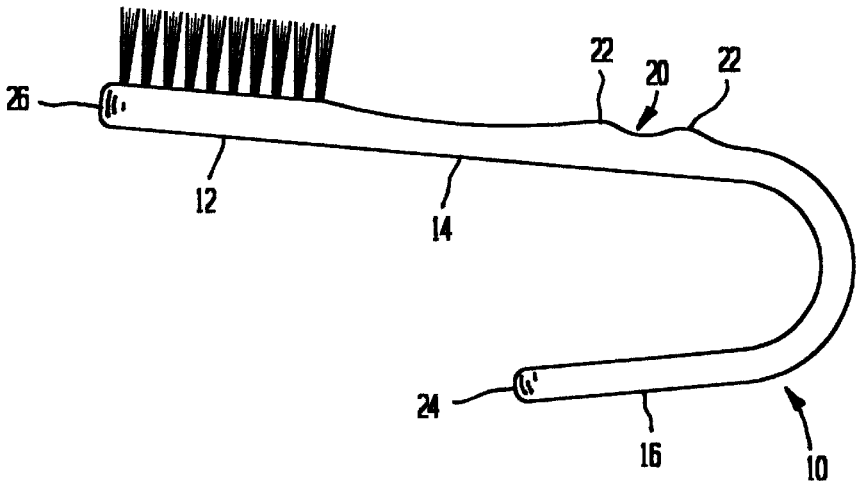
FIG. 4 is a side view of the flexible toothbrush of FIG. 1 in another flexed position.

The flexibility, softness, and elasticity of the handle 16 is illustrated in FIGS. 3–4. Although sufficiently resilient to be used in the normal, intended manner, the handle bends upon the application of a moderate force. The blunt edges and ends 24 and 26 of the body of the toothbrush 10 will not puncture human flesh upon the application of this moderate force. Further, the toothbrush body is designed with areas that are more susceptible to bending or flexing upon the application of a force. In particular, the small cross-sectional area of the neck 14 and the relatively thin handle 16 causes the brush to tend to flex more quickly at these areas upon the application of the force. Additionally, the Kratot polymers in the body of the toothbrush resist being abraded into a sharper edge. Even if the handle of the toothbrush is cut into a point, the brush is sufficiently flexible to not inflict a serious wound.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A flexible safety toothbrush, comprising a head portion, a neck portion connected to said head portion, and a handle portion connected to said neck portion, and further comprising a plurality of bristles attached directly to said head portion, said head portion, said neck portion, and said handle portion being constructed entirely of a flexible material, said material including approximately 50% of thermoplastic rubber and approximately 50% of polypropylene, whereby the toothbrush bends upon contact with a human body, has no sharp element, and thereby is optimized for use in correctional institutions because it cannot be used as a weapon.

2. A flexible toothbrush, comprising a head portion, a neck portion connected to said head portion, and a handle portion connected to said neck portion, and further comprising a plurality of bristles attached to said head portion, wherein said head portion, said neck portion, and said handle portion comprise a thermoplastic elastomer that resists being abraded into a point, said thermoplastic elastomer being a thermoplastic rubber, said head portion, said neck portion, and said handle portion being comprised of approximately 50% of said thermoplastic rubber and approximately 50% of polypropylene, said handle portion having a rounded proximal end and said head portion having a rounded distal end, wherein said head portion, said neck portion and said handle portion each have a width, said neck portion width being thinner than said head portion width and said handle portion width, and wherein said handle portion further has a length and a height, said handle portion height being not more than approximately one half of said handle portion width, and said handle portion width being less than one eighth of said handle portion length, said head portion, said neck portion, and said handle portion being sufficiently strong to be used for dental hygiene purposes and being sufficiently flexible to resist being sharpened and being used as a weapon.

* * * * *